US006150769A

United States Patent [19]

Nerone et al.

[11] Patent Number: 6,150,769

[45] **Date of Patent: *Nov. 21, 2000**

[54] GAS DISCHARGE LAMP BALLAST WITH TAPLESS FEEDBACK CIRCUIT

[75] Inventors: Louis R. Nerone, Brecksville; David J. Kachmarik, Strongsville, both of Ohio

[73] Assignee: General Electric Company, Schenectady, N.Y.

[ * ] Notice: This patent is subject to a terminal disclaimer.

[21] Appl. No.: 09/239,648

[22] Filed: Jan. 29, 1999

[51] Int. Cl.[7] ..... H05B 37/02

[52] U.S. Cl. ..... 315/209 R; 315/226

[58] Field of Search ..... 315/209 R, 225, 315/226, 307, 244, 289, 362, 291, DIG. 5, DIG. 7

[56] References Cited

U.S. PATENT DOCUMENTS

| | | | |
|---|---|---|---|
| 4,370,600 | 1/1983 | Zansky | 315/244 |
| 4,463,286 | 7/1984 | Justice | 315/DIG. 4 |
| 4,546,290 | 10/1985 | Kerekes | 315/287 |
| 4,588,925 | 5/1986 | Fahnrich et al. | 315/101 |
| 4,614,897 | 9/1986 | Kumbatovic | 315/224 |
| 4,647,817 | 3/1987 | Fahnrich et al. | 315/207 |
| 4,677,345 | 6/1987 | Nilssen | 315/219 |
| 4,692,667 | 9/1987 | Nilssen | 315/244 |
| 4,937,470 | 6/1990 | Zeller | 307/270 |
| 4,945,278 | 7/1990 | Chern | 315/DIG. 5 |
| 5,223,767 | 6/1993 | Kulka | 315/307 |
| 5,309,062 | 5/1994 | Perkins et al. | 315/DIG. 7 |
| 5,341,068 | 8/1994 | Nerone | 315/219 |
| 5,349,270 | 9/1994 | Roll et al. | 315/227 R |
| 5,355,055 | 10/1994 | Tary | 315/209 R |
| 5,387,847 | 2/1995 | Wood | 315/209 R |
| 5,406,177 | 4/1995 | Nerone | 315/307 |
| 5,514,981 | 5/1996 | Tam et al. | 326/80 |
| 5,796,214 | 8/1998 | Nerone | 315/209 R |
| 5,952,790 | 9/1999 | Nerone et al. | 315/307 |
| 5,965,985 | 10/1999 | Nerone | 315/209 R |

OTHER PUBLICATIONS

Nerone et al., "Ballast Circuit for Gas Discharge Lamp," specification, claims and drawing for application Serial No. 08/897,345, filed Jul. 21, 1997, commonly owned with subject application (attorney docket No. LD 10980), and Preliminary Amendment (attorney docket No. 11009).

Nerone, "Gas Discharge Lamp with Output Voltage Clamping Circuit," specification, claims and drawing for application Serial No. 09/192,785, filed Nov. 16, 1998, commonly owned with subject application (attorney docket No. LD 11136).

Nerone et al., "Gas Discharge Lamp with Piezoelectric Transformer," specification, claims and drawing for application Serial No. 09/139,311, filed Aug. 25, 1998, commonly owned with subject application (attorney docket No. LD 11048).

*Primary Examiner*—Don Wong
*Assistant Examiner*—Thuy Vinh Tran
*Attorney, Agent, or Firm*—Fay, Sharpe, Fagan, Minnich & McKee, LLP

[57] ABSTRACT

A ballast circuit for a gas discharge lamp with a tapless feedback circuit is disclosed. The ballast circuit comprises a d.c.-to-a.c. converter circuit with circuitry for coupling to a resonant load circuit, for inducing a.c. current therein. The converter circuit comprises a pair of switches serially connected between a bus conductor at a d.c. voltage and a reference conductor. The voltage between a reference node and a control node of each switch determines the conduction state of the associated switch. The respective reference nodes of the switches are connected together at a common node through which the a.c. current flows, and the respective control nodes of the switches are connected together. A gate drive arrangement regeneratively controls the first and second switches. It comprises a coupling circuit including an inductor for coupling to the control nodes a feedback signal representing current in the load circuit. It further comprises a tapless feedback circuit for providing the feedback signal. The feedback circuit comprises a capacitor coupled at one end to the common node in such manner as to conduct load current, and coupled at another end to the inductor.

12 Claims, 1 Drawing Sheet

GAS DISCHARGE LAMP BALLAST WITH TAPLESS FEEDBACK CIRCUIT

CROSS-REFERENCE TO RELATED APPLICATION

This application is related to commonly owned application Ser. No. 09/192,785, filed on Nov. 16, 1998, which has become U.S. Pat. No. 6,078,143.

FIELD OF THE INVENTION

The present invention relates to a ballast, or power supply circuit, for a gas discharge lamp of the type using gate drive circuitry to regeneratively control a pair of serially connected, complementary conduction-type switches of a d.c.-to-a.c. converter. More particularly, the invention relates to the use of a circuit for feeding back to the gate drive circuitry a signal representing load current, which does not require a tap into an inductor in the load circuit.

BACKGROUND OF THE INVENTION

U.S. Pat. No. 5,796,214, issued to the present inventor and assigned to the instant assignee, discloses various gas discharge lamp ballast circuits of the type using gate drive circuitry to regeneratively control a pair of serially connected, complementary conduction-type switches of a d.c.-to-a.c. converter. The gate drive circuitry includes a feedback circuit which obtains a signal representing load current by including a feedback inductor mutually coupled to an inductor in the load circuit. The mutual coupling is typically carried out by forming the feedback inductor as a tap of the load inductor. This requires the load inductor to be custom designed, increasing its cost. If such a tapped inductor could be eliminated, the cost of the ballast could be reduced significantly.

SUMMARY OF THE INVENTION

The present invention provides, in an exemplary embodiment, a ballast circuit for a gas discharge lamp with a tapless feedback circuit. The ballast circuit comprises a d.c.-to-a.c. converter circuit with circuitry for coupling to a resonant load circuit, for inducing a.c. current therein. The converter circuit comprises a pair of switches serially connected between a bus conductor at a d.c. voltage and a reference conductor. The voltage between a reference node and a control node of each switch determines the conduction state of the associated switch. The respective reference nodes of the switches are connected together at a common node through which the a.c. current flows, and the respective control nodes of the switches are connected together. A gate drive arrangement regeneratively controls the first and second switches. It comprises a coupling circuit including an inductor for coupling to the control nodes a feedback signal representing current in the load circuit. It further comprises a tapless feedback circuit for providing the feedback signal. The feedback circuit comprises a capacitor coupled at one end to the common node in such manner as to conduct load current, and coupled at another end to the inductor.

By eliminating a tapped inductor in the feedback circuit of the foregoing ballast, a significant cost savings can be realized.

DETAILED DESCRIPTION OF THE INVENTION

Figure 1:
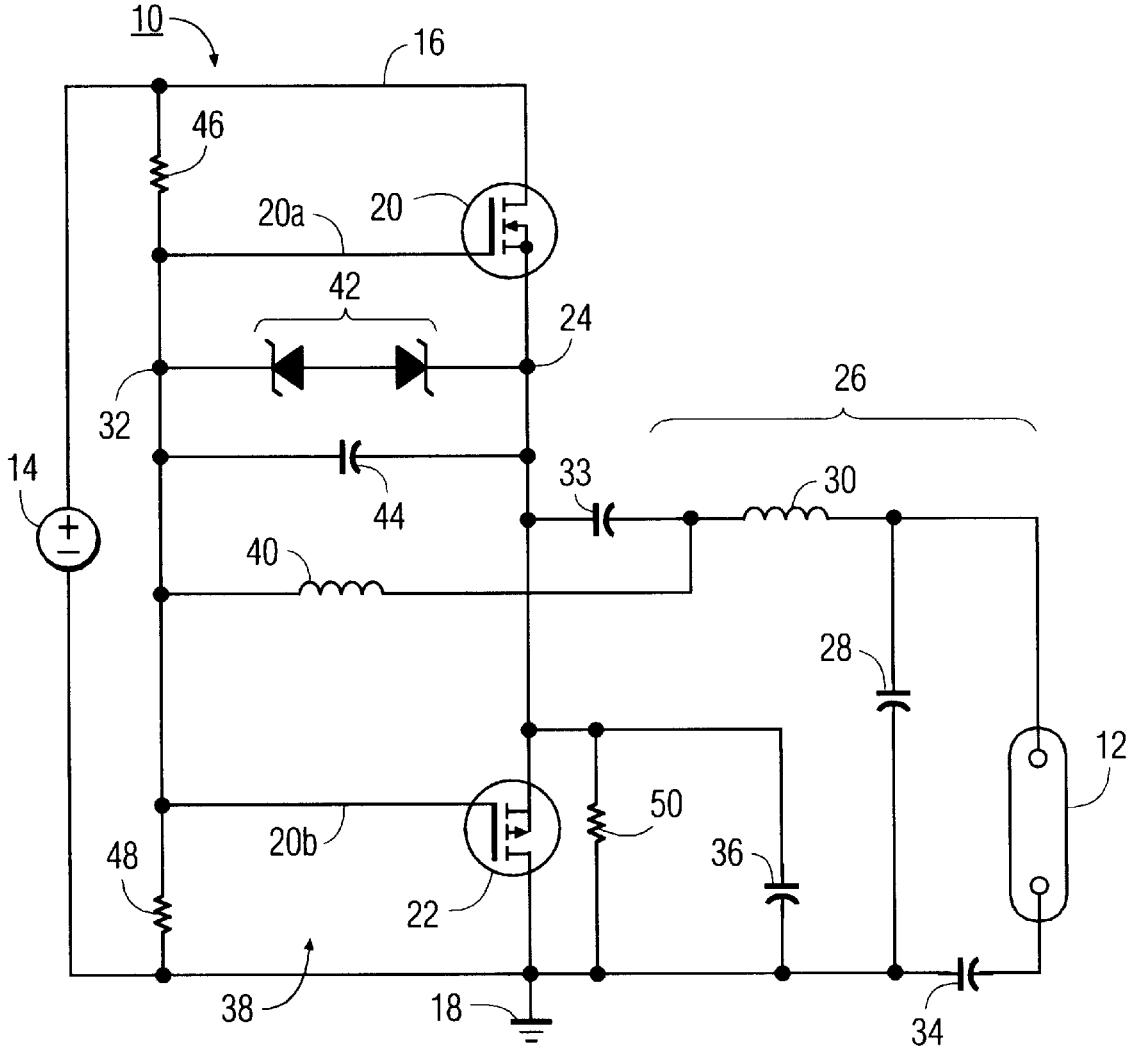
FIG. 1 is a schematic diagram of a ballast circuit in accordance with the invention.

FIG. 1 shows a ballast circuit 10 in accordance with the present invention. A gas discharge lamp 12, such as a fluorescent lamp, is powered from a d.c. bus voltage provided by a source 14 and existing between a bus conductor 16 and a reference conductor 18, after such voltage is converted to a.c. Switches 20 and 22, serially connected between conductors 16 and 18, are used in this conversion process. When the switches comprise n-channel and p-channel enhancement mode MOSFETs, respectively, the source electrodes of the switches are preferably connected directly together at a common node or conductor 24. The switches may comprise other devices having complementary conduction modes, such as PNP and NPN Bipolar Junction Transistors.

An exemplary resonant load circuit 26 includes lamp 12. A resonant capacitor 28 and a resonant inductor 30 determine frequency of resonance of the load circuit. Circuit 26 also includes a feedback capacitor 33 and a d.c. blocking capacitor 34. A conventional snubber capacitor 36 causes switches 20 and 22 to switch softly.

Switches 20 and 22 cooperate to provide a.c. current from common node 24 to load circuit 26. The gate, or control, electrodes 20*a* and 22*a* of the switches preferably are directly connected together at a control node or conductor 32. Gate drive circuitry, generally designated 38, is connected between nodes 24 and 32, for regeneratively controlling the switches. A feedback signal from the right-hand shown lead of feedback capacitor 33 is coupled to control node 32, preferably via an inductor 40. In addition to providing the feedback signal, capacitor 33 is also used during circuit start-up, as described below. Capacitor 33 is preferably connected directly between common node 24 and inductor 40, and inductor 40 is preferably connected directly between capacitor 33 and control node 32; however, persons of ordinary skill in the art will recognize that the connections can be other than directly in an electrical sense; that is, by interposing components that do not substantially change the presently described operation of the invention.

A bidirectional voltage clamp 42 connected between nodes 24 and 32, such as the back-to-back Zener diodes shown, helps to cause the phase angle between the fundamental frequency component of voltage across load circuit 26 (e.g., from common node 24 to reference node 18) and the a.c. current in resonant inductor 30 to approach zero during lamp ignition.

A capacitor 44 is preferably provided between nodes 24 and 32 to predictably limit the rate of change of control voltage between such nodes. This beneficially assures, for instance, a dead time interval during switching of switches 20 and 22 wherein both switches are off between the times of either switch being turned on.

Serially connected resistors 46 and 48 cooperate with a resistor 50 for starting regenerative operation of gate drive circuit 38. In the starting process, capacitor 33 becomes charged upon energizing of source 14, via resistors 46, 48 and 50. Initially, the voltage across capacitor 33 is zero, and, during the starting process, inductor 40 provides a low impedance charging path. With resistors 46–50 being of equal value, for instance, the voltage on node 24, upon initial bus energizing, is approximately ⅓ (one-third) of bus voltage 14, and the voltage at node 32, between resistors 46 and 48 is approximately ⅓ (one-third) of bus voltage 14. In this manner, capacitor 33 becomes increasingly charged, from right to left as shown, until it reaches the threshold voltage of the gate-to-source voltage of upper switch 20 (e.g., 2–3 volts). At this point, the upper switch starts conducting, which then results in current being supplied by that switch to load circuit 26. In turn, the resulting current in the load circuit causes regenerative control of switches 20 and 22.

Typically, during steady state operation of ballast circuit 10, d.c. current is blocked from flowing through capacitor 33 by d.c. blocking capacitor 34. This prevents capacitor 33 from building up a d.c. component of offset voltage that could prematurely turn on one of the switches.

Rather than using resistor 50, an alternative resistor (not shown) may be placed in shunt across switch 20 rather than across switch 22. The operation of the resulting circuit is similar to that described above. However, initially, common node 24 assumes a higher potential than node 32, so that capacitor 33 becomes charged from left to right as shown. The results in an increasingly negative voltage between node 32 and node 24, which turns on switch 22 first.

Resistors 46 and 48 are both preferably used in the circuit of FIG. 1; however, the circuit functions substantially as intended with resistor 48 removed and using resistor 50. Starting might be somewhat slower and at a higher line voltage. The circuit also functions substantially as intended with resistor 46 removed and using the mentioned alternative resistor (not shown) shunting switch 20.

Exemplary component values for the circuit of FIG. 1 are as follows for a fluorescent lamp 12 rated at 11 watts, with a resistance of about 250 ohms, and with a d.c. bus voltage of 300 volts:

Resonant inductor 30 . . . 2.7 millihenries

Resonant capacitor 28 . . . 2.2 nanofarads

Capacitor 33 . . . 33 nanofarads

D.c. blocking capacitor 34 . . . 100 nanofarads

Inductor 40 . . . 820 microhenries

Capacitor 44 . . . 3.3 nanofarads

Capacitor 36 . . . 470 picofarads

Zener diodes 42, each . . . 10 volts

Resistors 46, 48 and 50, each . . . 560 k ohms

Further, switch 20 may be an IRFR310, n-channel, enhancement mode MOSFET, sold by International Rectifier Company, of El Segundo, Calif.; and switch 22, an IRFR9310, p-channel, enhancement mode MOSFET also sold by International Rectifier Company.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp with a tapless feedback circuit, comprising:

a) d.c.-to-a.c. converter circuit with means for coupling to a resonant load circuit, for inducing a.c. current therein, said converter circuit comprising:

i) a pair of switches serially connected between a bus conductor at a d.c. voltage and a reference conductor, the voltage between a reference node and a control node of each switch determining the conduction state of the associated switch;

ii) the respective reference nodes of said switches being connected together at a common node through which said a.c. current flows, and the respective control nodes of said switches being connected together;

b) a gate drive arrangement for regeneratively controlling said first and second switches, said arrangement comprising:

i) a coupling circuit including an inductor for coupling to said control nodes a feedback signal representing current in said load circuit; and ii) a tapless feedback circuit for providing said feedback signal; said feedback circuit comprising a capacitor coupled at one end to said common node in such manner as to conduct load current, and coupled at another end to said inductor.

2. The ballast circuit of claim 1, wherein said capacitor is connected directly between said common node and said inductor.

3. The ballast circuit of claim 1, wherein said inductor is connected directly between said capacitor and said control nodes.

4. The ballast circuit of claim 1, further including a network for supplying said capacitor with charge during lamp starting so as to create a pulse for starting one of said switches; said network including an impedance connected between said common node and one of said bus conductor and said reference conductor for setting the initial polarity of pulse to be generated by said capacitor.

5. The ballast circuit of claim 1, wherein said feedback signal is proportional to said load current.

6. The ballast circuit of claim 1, further comprising a bidirectional voltage clamp connected between said common node and said control nodes.

7. A ballast circuit for a gas discharge lamp with a tapless feedback circuit, comprising:

a) d.c.-to-a.c. converter circuit with means for coupling to a resonant load circuit, for inducing a.c. current therein, said converter circuit comprising:

i) a pair of switches serially connected between a bus conductor at a d.c. voltage and a reference conductor, the voltage between a reference node and a control node of each switch determining the conduction state of the associated switch;

ii) the respective reference nodes of said switches being connected together at a common node through which said a.c. current flows, and the respective control nodes of said switches being connected together;

b) a gate drive arrangement for regeneratively controlling said first and second switches, said arrangement comprising:

i) a coupling circuit including an inductor for coupling to said control nodes a feedback signal representing current in said load circuit;

ii) a tapless feedback circuit for providing said feedback signal; said feedback circuit comprising a capacitor coupled at one end to said common node in such manner as to conduct load current, and coupled at another end to said inductor; and iii) a bidirectional voltage clamp connected between said common node and said control nodes;

iv) said inductor cooperating with said voltage clamp is such manner that the phase angle between the fundamental frequency component of voltage across said load circuit and said a.c. load current approaches zero during lamp ignition.

8. The ballast circuit of claim 7, wherein said capacitor is connected directly between said common node and said inductor.

9. The ballast circuit of claim 7, wherein said inductor is connected directly between said capacitor and said control nodes.

10. The ballast circuit of claim 7, further including a network for supplying said capacitor with charge during lamp starting so as to create a pulse for starting one of said switches; said network including an impedance connected between said common node and one of said bus conductor and said reference conductor for setting the initial polarity of pulse to be generated by said capacitor.

11. The ballast circuit of claim 7, wherein said feedback signal is proportional to said load current.

12. The ballast circuit of claim 7, wherein each of said switches is a MOSFET.

* * * * *